US005104756A

United States Patent [19]

Fukuda et al.

[11] Patent Number: 5,104,756

[45] Date of Patent: Apr. 14, 1992

[54] ELECTROPHOTOGRAPHIC PHOTORECEPTOR HAVING ANODIZED ALUMINUM CHARGE TRANSPORTING LAYER

[75] Inventors: Yuzuru Fukuda; Shigeru Yagi; Ken-ichi Karakida, all of Kanagawa, Japan

[73] Assignee: Fuji Xerox Co., Ltd., Tokyo, Japan

[21] Appl. No.: 595,772

[22] Filed: Oct. 12, 1990

Related U.S. Application Data

[63] Continuation of Ser. No. 325,189, Mar. 17, 1989, abandoned.

[30] Foreign Application Priority Data

Mar. 25, 1988 [JP] Japan ..... 63-69667

[51] Int. Cl.[5] ..... G03G 5/047

[52] U.S. Cl. ..... 430/58; 430/65; 430/84

[58] Field of Search ..... 430/65, 67, 58, 64, 430/84

[56] References Cited

U.S. PATENT DOCUMENTS

| | | | |
|---|---|---|---|
| 4,369,242 | 1/1983 | Arimili et al. | 430/58 |
| 4,457,971 | 7/1984 | Caldwell et al. | 430/65 |
| 4,786,573 | 11/1988 | Amada et al. | 430/65 |
| 4,792,510 | 12/1988 | Kumano et al. | 430/65 |

FOREIGN PATENT DOCUMENTS 63-63051 3/1988 Japan .

*Primary Examiner*—John Goodrow
*Attorney, Agent, or Firm*—Finnegan, Henderson, Farabow, Garrett, and Dunner

[57] ABSTRACT

An electrophotographic photoreceptor is disclosed, comprising a substrate, a charge transporting layer and a charge generating layer, wherein at least the surface of the substrate comprises aluminum or an aluminum alloy, and the charge transporting layer comprises an anodized aluminum film formed by anodizing the surface of the substrate.

6 Claims, 1 Drawing Sheet

ELECTROPHOTOGRAPHIC PHOTORECEPTOR HAVING ANODIZED ALUMINUM CHARGE TRANSPORTING LAYER

This application is a continuation of application Ser. No. 325,189, filed Mar. 17, 1989, now abandoned.

FIELD OF THE INVENTION

The present invention relates to an electrophotographic photoreceptor, and particularly, is directed to an electrophotographic photoreceptor having a function-separated type light-sensitive layer.

BACKGROUND OF THE INVENTION

Recently, a so-called "function-separated" type of electrophotographic photoreceptor has received wide attention. The light-sensitive layer of such photoreceptors comprises a charge generating layer which generates an electric charge when irradiated with light, and a charge transporting layer through which the electric charge generated by the charge generating layer can be efficiently injected and transferred. Amorphous silicon is generally used as the light-sensitive material in the preparation of the charge generating layer. An amorphous material produced by plasma chemical vapor deposition (CVD) method is generally used in the preparation of the charge transporting layer. The reason such electrophotographic photoreceptors have received such wide attention is due to the potentially dramatic improvements in chargeability and productivity which may be realized in conventional amorphous silicon based electrophotographic photoreceptors without compromising light sensitivity, high contrast and thermal stability, all of which are positive characteristics of amorphous silicon. There is also a potential for obtaining electrophotographic photoreceptors which have electrically stable repeating characteristics and long life. Accordingly, amorphous silicon based electrophotographic photoreceptors having a variety of different charge transporting layers have been proposed. In such function-separated type amorphous silicon-based electrophotographic photoreceptors, a charge transporting layer made of silicon oxide or amorphous carbon formed by the plasma CVD method as disclosed in, for example, U.S. Pat. No. 4,634,648 can be used.

As previously noted, in a conventional amorphous silicon based electrophotographic photoreceptor, chargeability may be enhanced with a reduction in dark decay by employing a layered structure having a charge transporting layer and a charge generating layer, wherein amorphous silicon is used in the preparation of the charge generating layer and a substance having a lower dielectric constant and a higher electrical resistance than amorphous silicon is used in the preparation of the charge transporting layer. The film forming speed of a film produced using the above plasma CVD method, however, is nearly equal to that of an amorphous film, and as a result, the layered structure is prone to complications. The complications include problems associated with increased potential of generating film defects, the problem of decline in productivity of the photoreceptor, and greatly increased production costs.

SUMMARY OF THE INVENTION

The present invention overcomes the problems and disadvantages cf the prior art by providing an electrophotographic photoreceptor having a novel charge transporting layer. The present invention is believed to represent a vast improvement and a completely novel approach for satisfying and meeting the needs, requirements and criteria for an effective and useful electrophotographic photoreceptor in an efficient and cost diffective manner.

Therefore, an object of the present invention is to provide an electrophotographic photoreceptor having a novel charge transporting layer.

Another object of the present invention is to provide a highly desirable electrophotographic photoreceptor that has good adhesion properties, high mechanical strength and that embodies a minimal level of defects.

Further object of the present invention is to provide an electrophotographic photoreceptor that exhibits high sensitivity, has excellent panchromatic property, has high chargeability and minimizes dark decay, and further, that exhibits decreased residual potential after exposure to light.

Still another object of the present invention is to provide an electrophotographic photoreceptor having charging characteristics which are not influenced by changes in external atmosphere conditions.

Still further object of the present invention is to provide an electrophotographic photoreceptor which exhibits excellent image quality even under conditions of heavy and repeated use.

Additional objects and advantages of the present invention will be set forth, in part, in the description which follows and, in part, will be obvious from the description or may be learned by and attained by means of the instrumentalities and combination of steps particularly pointed out in the appended claims.

The present inventors have discovered JP-A-63-63051 that an oxide of aluminum can function as a charge transporting layer (The term "JP-A" as used herein means an "unexamined published Japanese patent application"). As a result of further investigations, it has been found that an aluminum oxide film produced by a specified method exhibits excellent physical and electrophotographic characteristics. Based on these findings, the present invention was conceived.

To achieve the foregoing objects and in accordance with the purpose of the present invention, as embodied and broadly described herein, the electrophotographic photoreceptor of the present invention comprises a substrate, a charge transporting layer and a charge generating layer, wherein the surface of the substrate comprises aluminum and the charge transporting layer comprises an anodized aluminum film formed by anodizing the substrate. The substrate may, alternatively, at least on its surface, be comprised of an aluminum alloy. The anodized aluminum film preferably has a thickness of from 1 to 100 $\mu$m (micrometer $= 10^{-3}$ mm).

The accompanying drawings, which are incorporated in and constitute a part of this specification, illustrate preferred embodiments of the present invention and, together with the description, serve to explain the principles of the present invention.

DETAILED DESCRIPTION OF THE INVENTION

Reference will now be made, in detail, to preferred embodiments of the present invention, examples of which are illustrated in the accompanying drawings. Whenever possible, the same reference numbers will be used throughout the drawings to refer to the same or like parts.

Figure 1:
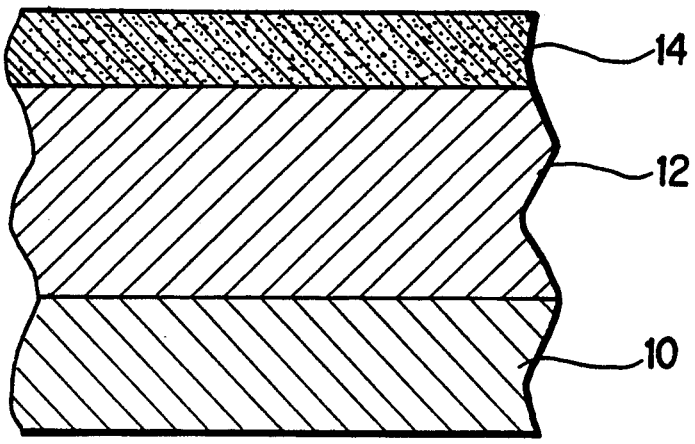
FIG. 1 is a schematic, cross-sectional view of an embodiment of the present invention illustrating the basic layered structure of the electrophotographic photoreceptor of the present invention.
Figure 2:
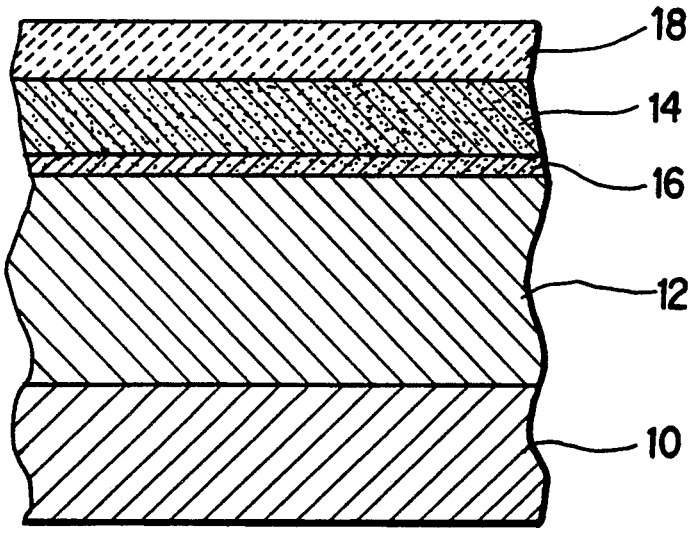
FIG. 2 is a schematic, cross-sectional view of another embodiment of the present invention.

Referring to FIG. 1 and in accordance with the present invention, it may be seen that an anodized aluminum film 12 is formed on a substrate 10, and a charge generating layer 14 is formed on the anodized aluminum film 12. Referring to FIG. 2, an intermediate layer 16 is formed between the anodized aluminum film 12 and the charge generating layer 14, and a surface layer 18 is formed on the surface of the charge generating layer 14.

In the present invention, the substrate 10 may be made of aluminum, aluminum alloy (hereinafter referred to merely as "aluminum"), or an electrically conductive or insulating substance other than aluminum. In the case of substrates which are made of substances other than aluminum, however, it is necessary that an aluminum film having a thickness of generally 5 μm or more (preferably from 5 to 50 μm and more preferably from 10 to 30 μm) be formed on at least a surface of the substrate which is to come into contact with another layer. This aluminum film can be formed by, for example, vapor deposition, sputtering or ion plating. Electrically conductive substrates other than aluminum include, for example, stainless steel, and metals such as nickel, chromium and the like, or their alloys. Insulating substrates include, for example, films or sheets of polymers such as polyester, polyethylene, polycarbonate, polystyrene, polyamide or polyimide, glass, and ceramics.

An aluminum material for use in preparation of an anodized aluminum film having good characteristics can be chosen appropriately from pure aluminum-based materials and aluminum alloy materials such as, for example, Al-Mg, Al-Mg-Si, Al-Mg-Mn, Al-Mn, Al-Cu-Mg, Al-Cu-Ni, Al-Cu, Al-Si, Al-Cu-Zn, and Al-Cu-Si.

The aluminum surface of the substrate is anodized in an aqueous solution containing an electrolyte, whereby an anodized aluminum film comprising a barrier layer and a porous layer and having a desired thickness is formed and acts as a charge transporting layer. The anodized aluminum film can be formed by known techniques and methods. The electrolyte used in forming the anodized film can be appropriately chosen from sulfuric acid, oxalic acid, chromic acid, phosphoric acid, sulfamic acid, and benzenesulfonic acid, which are film dissolving electrolytes. Use of such suitable electrolytes permits the formation of an anodized aluminum film having the necessary thickness for use as the charge transporting layer.

In performing electrolysis, both DC and AC sources can be used. Although the following explanation is made in reference with the case when a DC source is used in electrolysis, the desired anodized aluminum film can be formed similarly by the use of an AC source.

In order to form an anodized aluminum film on the substrate, a substrate having an aluminum surface which is mirror finished and has the desired form is washed in an organic solvent such as flon (i.e., chlorinated fluorohydrocarbons) and, subsequently, in pure water by the use of supersonic waves. After this cleaning, if desired, the aluminum surface of the substrate may be subjected to pretreatment, e.g., pretreatment in boiling pure water or pretreatment with boiling water or heated steam. Such treatment is preferably employed because it produces good results, e.g., a reduction in the amount of the needed electricity and an improvement in film characteristics.

Subsequently, an anodized aluminum film is formed on the substrate. An electrolyte solution (anodization solution) is filled to a predetermined level in an electrolytic cell (anodization cell) made of, e.g., stainless steel or hard glass. As the electrolyte solution, a solution of an electrolyte in pure water is usually used. The concentration of the electrolyte in pure water is, under standard conditions (0° C., 1 atmospheric pressure), from about 0.01 to 90% by weight when the electrolyte is solid and from about 0.01 to 85% by volume when the electrolyte is liquid. As for the pure water, for example, distilled water or ion exchanged water can be used. In order to prevent corrosion or formation of pin holes in the anodized aluminum film, it is preferred that impurities, e.g., chlorine, in particular, be completely removed from the water.

The above substrate having an aluminum surface is placed in the electrolyte solution as the anode, and a stainless steel plate or an aluminum plate is placed as the cathode in the electrolyte solution with a certain amount of clearance or distance from the substrate. The distance between the anode and the cathode is determined appropriately to be within a range between about 0.1 and 100 cm. A positive (plus) terminal and a negative (minus) terminal of a DC electric source are then connected to the aluminum surface and the cathode plate, respectively, and electricity is applied between the anode and the cathode in the electrolyte solution. This application of electricity produces an anodized film on the aluminum surface of the substrate.

The anodized aluminum film thus formed comprises a non-porous base layer (i.e., barrier layer) having a thickness which varies in direct proportion to the electrolytic voltage, and a porous layer formed on the base layer having a thickness which is determined by the type of the electrolyte, electric voltage, current density, temperature and other such factors.

The current density at the time of anodization is usually from about 0.0001 to 10 $A/cm^2$ and preferably from about 0.0005 to 1 $A/cm^2$. The anodization votage is usually from about 0.1 and 1,000 V and is preferably from about 0.1 to 700 V. The temperature of the electrolyte solution is set from about 0° to 100° C. and is preferably from about 10° to 95° C.

If desired, the anodization coating thus formed may be subjected to a treatment to close or fill the pores, e.g., treatment in boiling pure water. The anodized aluminum film may be colored by adsorption or deposition of dyes, inorganic salts, metal salts or metals on a porous layer of the aluminum film using methods such as dipping or electrolysis. The charge transporting layer comprising an anodized aluminum film having a porous layer colored in the manner as described above acts as a reflection preventing layer absorbing light transmitting through the charge generating layer to be formed thereon, and thus is suitable as a photoreceptor for a semiconductor laser printer. Incorporation of metal in the porous layer is preferred because it increases the charge transporting ability of the charge transporting layer.

The anodized aluminum film thus formed is dried, if desired, after rinsing with, for example, pure water. The thickness of the anodized aluminum film is generally from about 1 to 100 μm, is preferably from about 5 to 50 μm, more preferably from about 5 to 40 μm.

Subsequently, an charge generating layer is formed on the anodized aluminum film. The charge generating layer may be formed by CVD, vacuum-deposition or sputtering, of an inorganic material, e.g., amorphous silicon, selenium, hydrogen selenide or selenium-tellurium. The charge generating layer may also be formed using thin films formed by vacuum-depositing a dye, e.g., phthalocyanine, copper-phthalocyanine, Al-phthalocyanine, squarylium acid derivatives or bisazo dye, or by dispersing the dye in a binder resin followed by dip coating. In particular, when amorphous silicon or amorphous silicon with germanium added thereto is used, excellent mechanical and electrical characteristics can be obtained and is therefore preferred.

A method for forming an charge generating layer will now be described with reference to the case when amorphous silicon is used.

A charge generating layer primarily comprising amorphous silicon can be formed by known methods, e.g., the glow discharge decomposition method, the sputtering method, the ion plating method or the vacuum deposition method. The appropriate film forming method is chosen depending on the purpose and desired objective. The method in which silane or silane-based gas is subjected to glow discharge decomposition according to the plasma CVD method is, however, preferably employed. In accordance with this method, an amorphous silicon film that has a relatively high level of dark resistance because of hydrogen contained therein and that has a high level of sensitivity to light is formed. Accordingly, the film possesses characteristics suitable for use as a charge generating layer.

A method for forming a charge generating layer using the plasma CVD method will now be described.

Silanes, as exemplified by silane and disilane, can be used as the feed material to form an amorphous silicon light-sensitive layer made mainly of silicon. In the formation of the charge generating layer, a carrier gas, e.g., hydrogen, helium, argon or neon, may be used, if desired. It is also possible to add a dopant gas, e.g., diborane ($B_2H_6$) gas or phosphine ($PH_3$) gas, to the feed material gas, thereby adding an impurity element, e.g., boron or phosphine in the film. For the purpose of increasing light sensitivity, a halogen atom, a carbon atom, an oxygen atom or a nitrogen atom, for example, may be incorporated in the light-sensitive layer. Moreover, for the purpose of increasing sensitivity in the longer wavelength region, additional elements, e.g., germanium and tin, may be added.

In the present invention, it is preferred that the electric charge generating layer contain silicon as a main component and contain generally from about 1 to 40 atom %, preferably from about 5 to 20 atom % of hydrogen. The thickness of the charge generating layer is desirably within the range of from about 0.1 to 30 μm, preferably from about 0.2 to 5 μm.

In the electrophotographic photoreceptor of the present invention, other additional layers may be formed, if desired, adjacent to the upper or lower surface of the charge generating layer. These additional layers will now be described.

Examples of intermediate layers include those capable of controlling electric and image characteristics of the photoreceptor, e.g., a p-type semiconductor layer comprising amorphous silicon and an element selected from Group III or V of the Periodic Table added thereto, an n-type semi-conductor layer, an insulating layer of, e.g., silicon nitride, silicon carbide, silicon oxide, amorphous carbon or the like, and a layer containing elements selected from both Groups IIIB and V of the Periodic Table. The thickness of each layer can be determined appropriately and is usually set within the range of from about 0.01 to 10 μm. Preferred thickness of the intermediate layers is from about 0.01 to 5 μm.

Furthermore, there may be provided a surface protective layer for protecting the surface of the electrophotographic photoreceptor against deterioration due to corona ions. The surface protective layer preferebly has a thickness of from about 0.1 to 10 μm.

The above-described additional layers can be formed by the plasma CVD method. As explained in the case of the charge generating layer, when an impurity element is added, a gassified product of a substance containing the impurity element is introduced into a plasma CVD apparatus along with silane gas, after which glow discharge decomposition is carried out. Film forming conditions of each layer are as follows: the frequency is usually from about 0 to 5 GHZ and preferably from about 0.5 to 3 GHZ, the degree of vacuum at the time of discharging is from about $1\times10^{-5}$ to 5 Torr (0.001 to 665 Pa), and the substrate heating temperature is from about 100° to 400° C.

Since the electrophotographic photoreceptor of the present invention has, as described above, a charge transporting layer comprising an anodized aluminum film, the adhesion and intimate properties between the charge transporting layer and the substrate or the charge generating layer are markedly high. Additionally, the photoreceptor has high mechanical strength and hardness, and exhibits a minimal amount of defects. Accordingly, the electrophotographic photoreceptor of the present invention exhibits excellent durability. Moreover, the electrophotographic photoreceptor of the present invention exhibits a high degree of sensitivity, exhibits an excellent panchromatic property, possesses high chargeability, minimizes dark decay, and also exhibits a minimal amount of residual potential after light exposure. Additionally, its charging characteristics are not influenced by changes in external atmospheric conditions. Moreover, it produces an image of excellent quality even after heavy and repeated use.

The present invention will now be described with reference to the following examples.

EXAMPLE 1

A cylindrical aluminum pipe made of 99.99% purity Al-Mg alloy and having a diameter of about 120 mm was used as a substrate. This pipe was subjected to washing with flon and supersonic wave washing in distilled water, and then subjected to treatment in boiling pure water for 15 minutes. A 4 wt % phosphoric acid solution was used as the electrolyte solution, and anodization was carried out for 60 minutes by applying a DC voltage of 60 V between the aluminum pipe and a stainless steel plate as a cylindrical cathode while maintaining the solution at 28° C. The thickness of the anodized aluminum film thus formed was 20 μm.

The aluminum pipe having the above anodized aluminum film formed thereon was subjected to supersonic wave washing in distilled water and dried at 100° C., and then placed in a vacuum cell of a capacitively coupled RF glow charge apparatus (plasma CVD). The aluminum pipe was maintained at 250° C., and into the vacuum cell, 100% purity silane ($SiH_4$) gas was introduced at a rate of 250 ml per minute, 100 ppm diborane ($B_2H_6$) gas diluted with hydrogen was introduced at a rate of 3 ml per minute, and further 100% purity hydrogen ($H_2$) gas was introduced at a rate of 250 m( per minute. After the inner pressure of the vacuum cell was maintained at 1.5 Torr (200.0N/m$^2$), 13.56 MHz high frequency electric power was applied to produce glow discharge, and the output of the high frequency electric source was maintained at 350 W. In this manner, a 2 μm thick charge generating layer made of so-called i-type amorphous silicon was formed that contained hydrogen and a minute amount of boron and which had high dark resistance.

An electrophotographic photoreceptor having a 20 μm thick anodized aluminum film charge transporting layer and a 2 μm thick i-type amorphous silicon charge generating layer on the aluminum pipe was thus obtained.

The electrophotographic photoreceptor was measured for positive charging characteristics. In a case where the current flowing into the photoreceptor was 10 μA/cm (microampere/cm), the charged potential immediately after charging was 600 V, and the dark decay was 10%/sec. After exposure with white light, the residual potential was 100 V, and the half exposure amount was 9 erg·cm$^{-2}$.

COMPARATIVE EXAMPLE 1

For comparison, a 2 μm thick light-sensitive layer of i-type amorphous silicon electrophotographic photoreceptor was formed on an aluminum pipe which had not been subjected to the treatment in boiling pure water and the anodization treatment in the manner and conditions as described above. This electrophotographic photoreceptor was measured for positive charging characteristics. In a case where the current flowing to the photoreceptor was 10 μA/cm, the charged potential immediately after charging was 60 V.

It can be seen from the above results that the anodized aluminum film functioned as a charge transporting layer.

EXAMPLE 2

A cylindrical aluminum pipe made of 99.99% purity Al-Mg alloy and having a diameter of about 120 mm was subjected to washing with flon and supersonic wave washing in distilled water, and then subjected to treatment in boiling pure water for 15 minutes. Subsequently, using a solution of 8% by volume of sulfuric acid and 0.5% by weight of aluminum sulfate in pure water as the electrolyte solution, anodization was carried out for 80 minutes by applying a DC voltage of 50 V between the aluminum pipe and a stainless steel plate as a cylindrical cathode while maintaining the solution at 25° C. The anodized aluminum film thus formed had a thickness of 17.5 μm.

The aluminum pipe having the anodized aluminum film formed thereon was subjected to supersonic wave washing in distilled water and dried at 100° C., and then placed in a vacuum cell of a capacitively coupled RF glow charge apparatus (plasma CVD). Thereafter, a charge generating layer was formed in the same manner as in Example 1.

The electrophotographic photoreceptor thus obtained was measured for positive charging characteristics. In a case where the current flowing to the photoreceptor was 10 μA/cm, the charged potential immediately after charging was 520 V and the dark decay was 15%/sec. After exposure with white light, the residual potential was 85 V, and the half exposure amount was 8 erg·cm$^{-2}$.

EXAMPLE 3

A cylindrical aluminum pipe made of 99.99% purity Al-Mg alloy and having a diameter of about 120 mm was subjected to washing with flon and supersonic wave washing in distilled water. Subsequently, using a 5 wt % oxalic acid solution as the electrolyte solution, anodization was carried out for 60 minutes by applying a DC voltage of 55 V between the aluminum pipe and a stainless steel plate as a cylindrical cathode while maintaining the solution at 30° C. The anodized aluminum film thus formed had a thickness of 16 μm.

The aluminum pipe with the anodized aluminum film formed thereon was subjected with supersonic wave washing and dried at 100° C. and then placed in a vacuum cell of a capacitively coupled RF glow charge apparatus (plasma CVD). Thereafter, a charge generating layer was formed in the same manner as in Example 1. The electrophotographic photoreceptor thus obtained was measured for positive charging characteristics. In the case where the current flowing to the photoreceptor was 10 μA/cm, the charged potential immediately after charging was 490 V, and the dark decay was 17%/sec. After exposure with white light, the residual potential was 70 V, and the half exposure amount was 8 erg·cm$^{-2}$.

EXAMPLE 4

A cylindrical aluminum pipe made of 99.99% purity Al-Mg alloy and having a diameter of about 120 mm was subjected to washing with flon and supersonic wave washing in distilled water. Subsequently, using a solution of 15% by volume of sulfuric acid in pure water as the electrolyte solution, anodization was carried out for 60 minutes by applying a DC voltage of 40 V between the aluminum pipe and a stainless steel plate as a cylindrical cathode while maintaining the solution at 35° C.

An electrolysis was carried out in a solution containing a nickel salt to deposit nickel in the pores of the porous layer. The anodized aluminum film thus formed had a thickness of 16 μm and was black in appearance.

The aluminum pipe with the anodized aluminum film formed thereon was subjected to supersonic wave washing in distilled water and dried at 100° C. and then placed in a vacuum cell of a capacitively coupled RF glow charge apparatus (plasma CVD). Thereafter, a charge generating layer was formed in the same manner as in Example 1. The electrophotographic photoreceptor thus obtained was measured for positive charging characteristics. In the case when the current flowing to the photoreceptor was 10 μA/cm, the charged potential immediately after charging was 440 V, and the dark decay was 18%/sec. After exposure with white light, the residual potential was 70 V and the half exposure amount was 7.5 erg·cm$^{-2}$.

It will be apparent to those skilled in the art that various modifications and variations can be made in the electrophotographic photoreceptor of the present invention without departing from the scope or spirit of the present invention. Thus, it is intended that the present invention cover the modifications and variations of this invention provided they come within the scope of the appended claims and their equivalents.

What is claimed is:

1. An electrophotographic photoreceptor comprising a substrate, a charge transporting layer, and a charge generating layer, wherein the surface of said substrate comprises aluminum or an aluminum alloy, said charge generating layer comprises amorphous silicon, and said charge transporting layer comprises an anodized aluminum film having a thickness of from about 5 to 50 microns.

2. The electrophotographic photoreceptor as claimed in claim 1, wherein said amorphous silicon contains germanium.

3. The electrophotographic photoreceptor as claimed in claim 1, wherein said anodized aluminum film is formed by anodizing the surface of said substrate.

4. The electrophotographic photoreceptor as claimed in claim 1, wherein said charge generating layer contains hydrogen in an amount of from about 1 to 40 atom %.

5. The electrophotographic photoreceptor as claimed in claim 1, wherein said charge generating layer has a thickness of from about 0.1 to 30 μm.

6. The electrophotographic photoreceptor as claimed in claim 1, wherein the anodized aluminum film has a thickness of from about 5 to 40 microns.

* * * * *